US008146710B2

(12) United States Patent
Moldthan et al.

(10) Patent No.: US 8,146,710 B2
(45) Date of Patent: Apr. 3, 2012

(54) STEP STOOL LATCH

(75) Inventors: Jason R. Moldthan, Hadley, PA (US); Timothy J. Brookbank, Girard, OH (US)

(73) Assignee: Werner Co., Greenville, PA (US)

( * ) Notice: Subject to any disclaimer, the term of this patent is extended or adjusted under 35 U.S.C. 154(b) by 0 days.

(21) Appl. No.: 12/657,703

(22) Filed: Jan. 25, 2010

(65) Prior Publication Data

US 2010/0200334 A1 Aug. 12, 2010

Related U.S. Application Data

(62) Division of application No. 10/957,244, filed on Oct. 1, 2004, now abandoned.

(51) Int. Cl.
*E06C 7/00* (2006.01)

(52) U.S. Cl. ..... 182/165; 182/180.1

(58) Field of Classification Search ..... 182/129, 182/165–177, 180.1; 292/124, 98, 169.11, 292/DIG. 14

See application file for complete search history.

(56) References Cited

U.S. PATENT DOCUMENTS

| | | | | |
|---|---|---|---|---|
| 311,910 | A * | 2/1885 | Moeller | 292/175 |
| 1,966,908 | A * | 7/1934 | Schumann | 292/124 |
| 4,280,692 | A * | 7/1981 | Hutchinson et al. | 271/160 |
| 5,762,163 | A * | 6/1998 | Kain | 182/161 |
| 6,026,933 | A * | 2/2000 | King et al. | 182/165 |
| 6,390,237 | B1 * | 5/2002 | Kim et al. | 182/161 |
| 6,550,579 | B2 * | 4/2003 | Gibson et al. | 182/161 |
| 6,709,030 | B2 * | 3/2004 | Furlong | 292/121 |
| 6,902,035 | B2 * | 6/2005 | Baumgartner et al. | 182/165 |

* cited by examiner

*Primary Examiner* — Alvin Chin Shue
(74) *Attorney, Agent, or Firm* — Ansel M. Schwartz

(57) ABSTRACT

A step stool includes a first section having at least a first step. The step stool includes a hinge bracket connected to the first section. The step stool includes a second section connected to the hinge bracket having a crossbar; and a platform having a latch that moves only in translation to lock the platform to the cross bar when the platform is in a horizontal position and prevents the first section and second section from folding when the first and second sections are in an open state. A method for establishing a step stool includes the steps of moving a latch of a platform only in translation away from a crossbar of a second section that the platform rests on in a horizontal position. There is the step of placing the second section and a first section having at least one step together into a closed position.

1 Claim, 6 Drawing Sheets

STEP STOOL LATCH

CROSS-REFERENCE TO RELATED APPLICATIONS

This application is a divisional of U.S. patent application Ser. No. 10/957,244 filed Oct. 1, 2004 now abandoned.

FIELD OF THE INVENTION

The present invention is related to a step latch of a step stool which locks the step stool in an open position. More specifically, the present invention is related to a step latch of a step stool which locks the step stool in an open position where the latch moves only in translation, without rotation.

BACKGROUND OF THE INVENTION

Step stools are very useful in the home or work allowing users to reach areas that would otherwise be unreachable, whether the intent is to access storage cabinets, do cleaning, change light bulbs, etc. Commonly, step stools have a latch that keeps the platform constrained to the rear rail while in use. Most latches are engaged as the platform strikes the rear section's crossbar. In one instance, the latch strikes first, causing the latch to cam by rotation out of the way of the crossbar. A responsive force, spring, gravity, etc., causes the latch to rotate back toward the crossbar, once the crossbar has moved past the latch. The latch is stopped by the inherent design of the platform or the latch. In the extended position, the latch has encompassed the crossbar to the point the crossbar is unable to be forced past the latch, unless the latch is rotated externally by hand to move away from the crossbar.

SUMMARY OF THE INVENTION

The present invention pertains to a step stool. The step stool comprises a first section having at least a first step. The step stool comprises a hinge bracket connected to the first section. The step stool comprises a second section connected to the hinge bracket having a crossbar; and a platform having a latch that moves only in translation to lock the platform to the cross bar when the platform is in a horizontal position and prevents the first section and second section from folding when the first and second sections are in an open state.

The present invention pertains to a method for establishing a step stool. The method comprises the steps of moving a latch of a platform only in translation away from a crossbar of a second section that the platform rests on in a horizontal position. There is the step of placing the second section and a first section having at least one step together into a closed position.

BRIEF DESCRIPTION OF THE DRAWINGS

In the accompanying drawings, the preferred embodiment of the invention and preferred methods of practicing the invention are illustrated in which.

DETAILED DESCRIPTION

Figure 1:
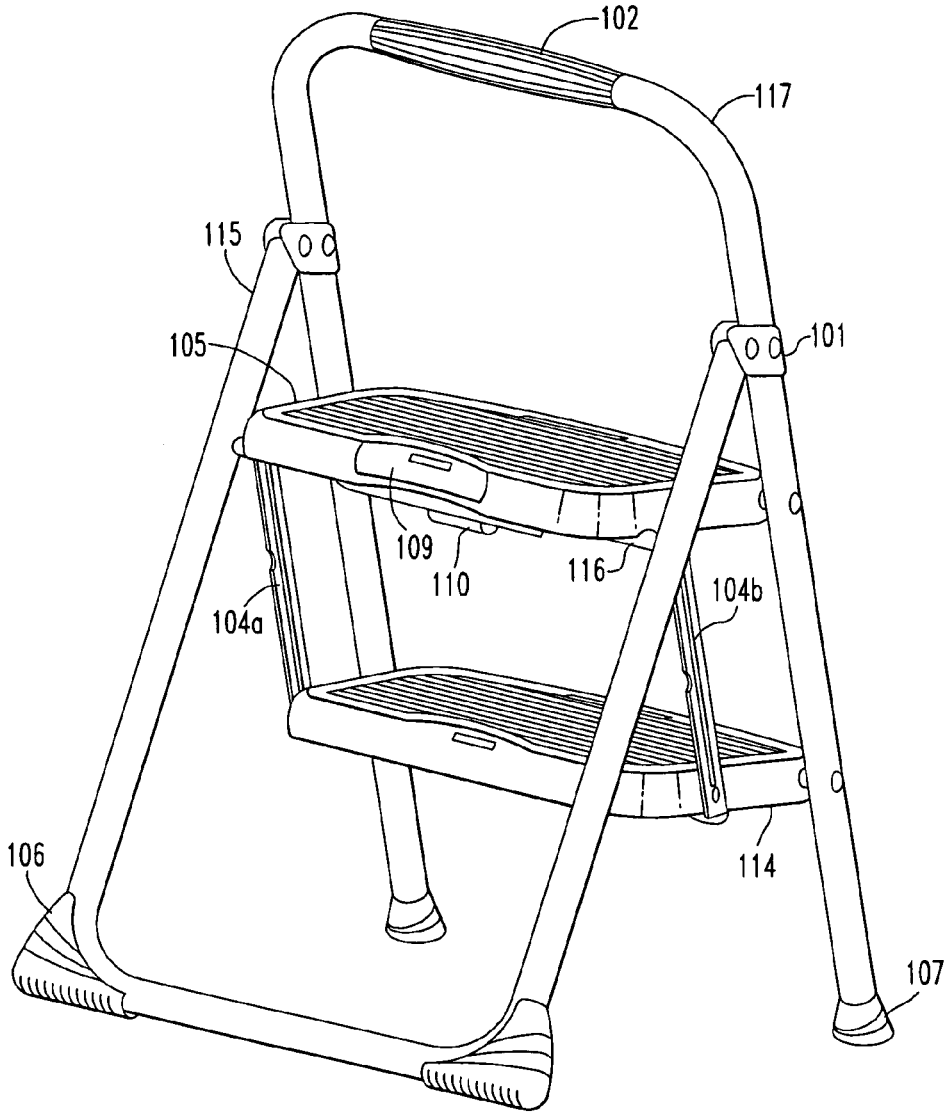
FIG. 1 is a schematic representation of a perspective view of a step stool of the present invention.
Figure 2:
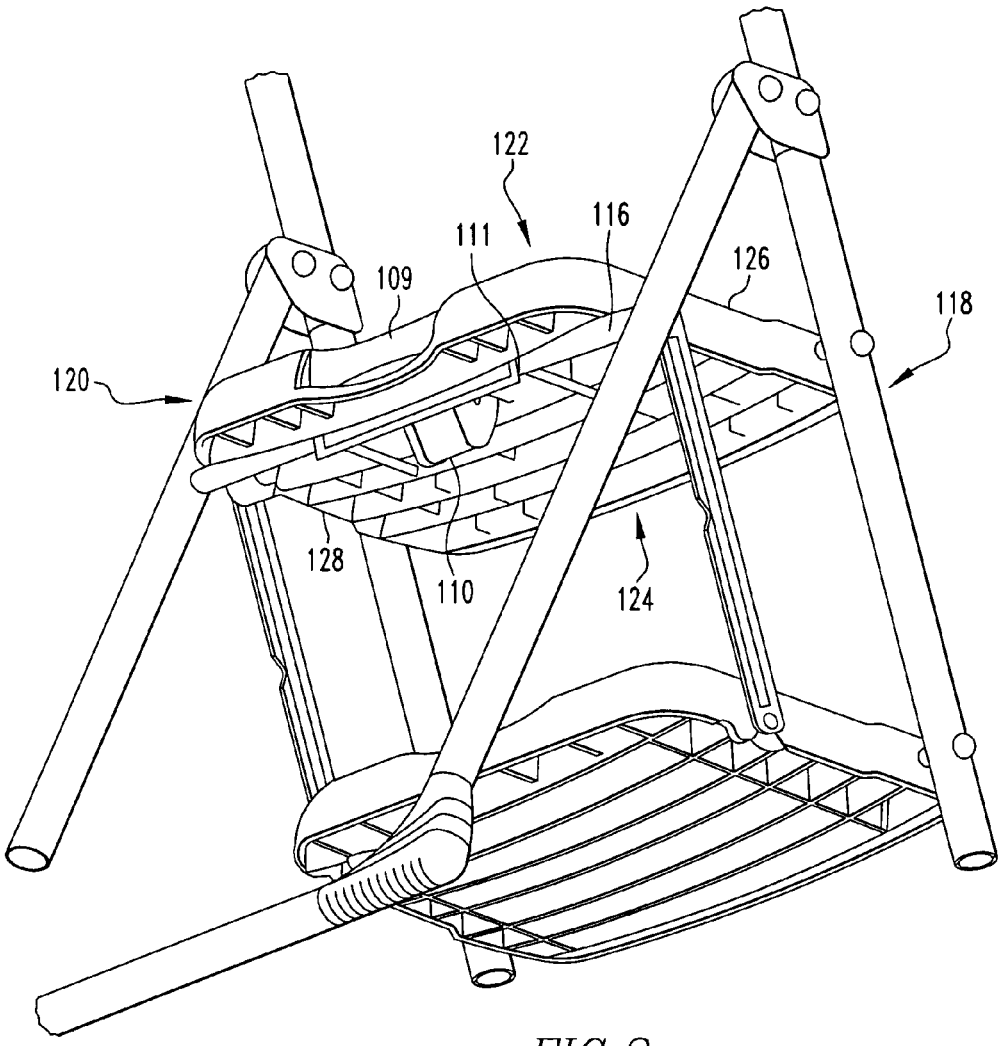
FIG. 2 is a schematic representation of an underside perspective view of a platform having a latch of the step stool.
Figure 3:
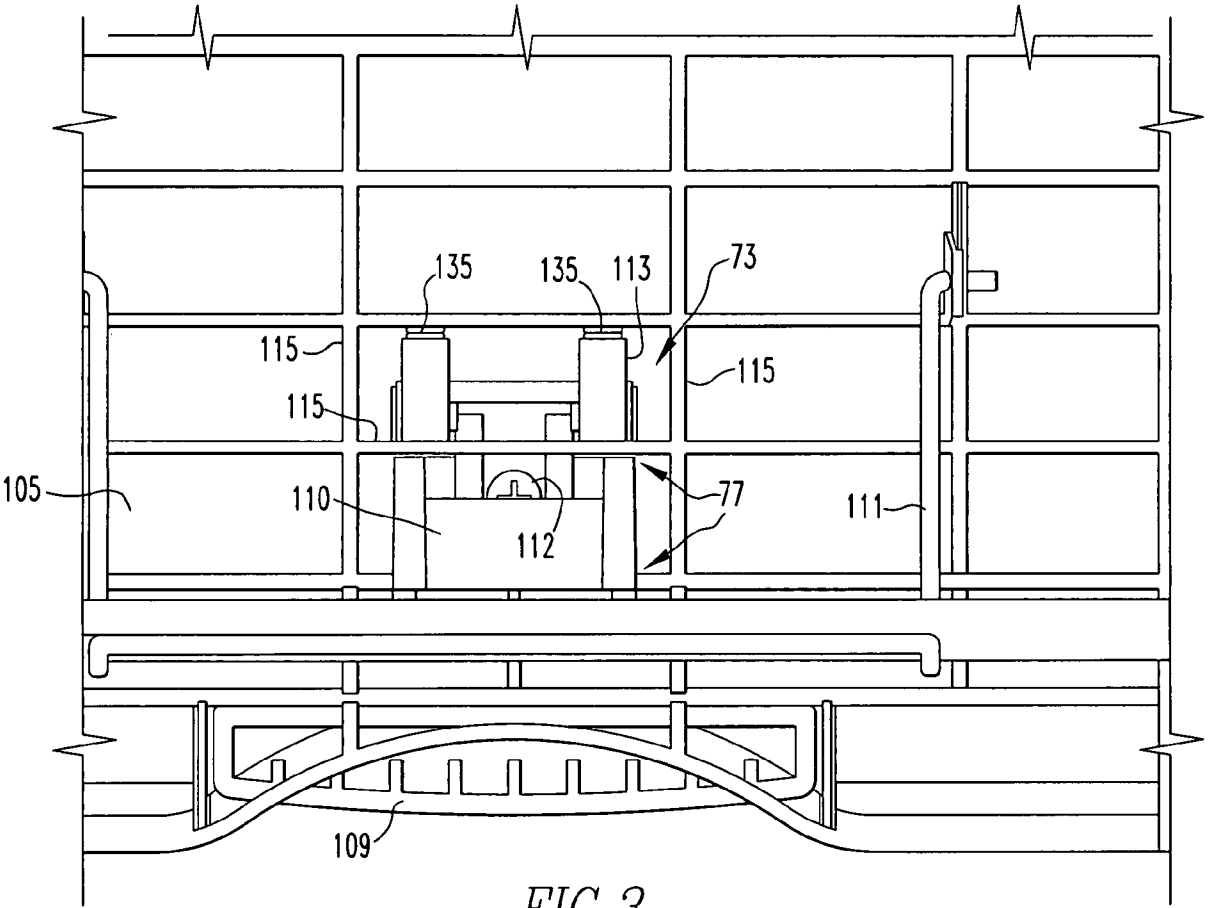
FIG. 3 is a schematic representation of an underside view of the platform having the latch.
Figure 4:
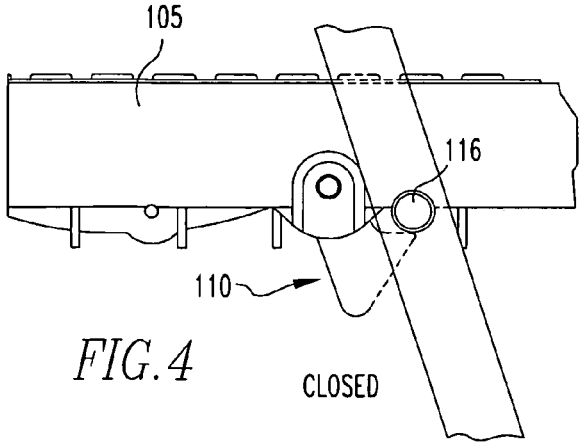
FIG. 4 is a schematic representation of a side view of the platform having the latch in a closed position.
Figure 5:
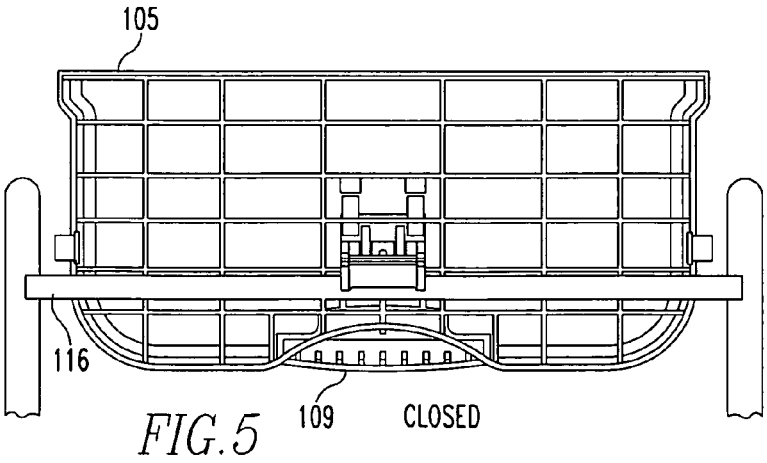
FIG. 5 is a schematic representation of an underside view of the platform having the latch in a closed position.
Figure 6:
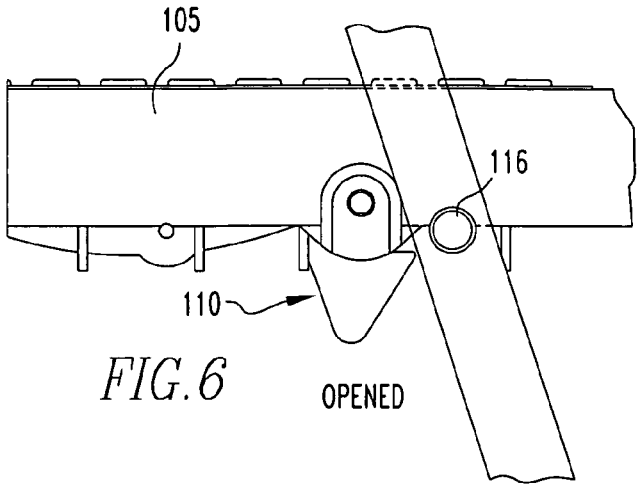
FIG. 6 is a schematic representation of a side view of the platform having the latch in an open position.
Figure 7:
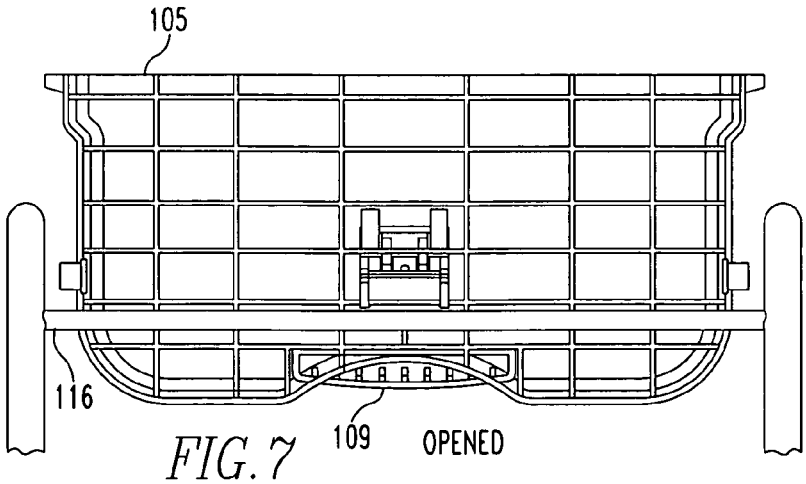
FIG. 7 is a schematic representation of an underside view of the platform having the latch in an open position.

Referring now to the drawings wherein like reference numerals refer to similar or identical parts throughout the several views, and more specifically to FIGS. 1-3 thereof, there is shown a step stool 99. The step stool 99 comprises a first section 100 having at least a first step 114. The step stool 99 comprises a hinge bracket 101 connected to the first section 100. The step stool 99 comprises a second section 103 connected to the hinge bracket 101 having a crossbar 116; and a platform 105 having a latch 110 that moves only in translation to lock the platform 105 to the cross bar 116 when the platform 105 is in a horizontal position and prevents the first section 100 and second section 103 from folding when the first and second sections 100, 103 are in an open state.

Preferably, the platform 105 includes forcing means that forces the latch 110 to move over the crossbar 116 after the latch 110 clears the crossbar 116 as a platform 105 moves into the horizontal position to lock the platform 105 width the crossbar 116. The forcing mechanism is connected to the latch 110. The forcing mechanism preferably includes a first spring 113. Preferably, the second section 103 has rails 115 to which the cross bar 116 is connected. The first section 100 preferably has rails 117 to which the platform 105 is attached.

Preferably, the second section 103 has a spreader 111 link that attaches the first section 100 to the second section 103 and allows the second section 103 to rotate toward the first section 100 while the step stool 99 is closing. The platform 105 preferably has a slider handle 109 connected to the latch 110 which moves the latch 110 only in translation away from the cross bar 116 when the platform 105 is in the horizontal position and the slider handle 109 is moved, which frees the crossbar 116 from the latch 110 and allows the first and second sections 100, 103 to fold together. Preferably, the platform 105 has a front side 118 and a back side 120 opposing the front side 118 and the slider handle 109 is disposed adjacent the back side 120.

The platform 105 preferably has a top 122 and bottom 124 and the latch 110 is disposed on the bottom 124 of the platform 105. Preferably, the platform 105 has a right side 126 and a left side 128 opposing the right side 126, the right side 126 and left side 128 connected to the front side 118 and rear side. The platform 105 preferably has a rectangular shape.

Figure 8:
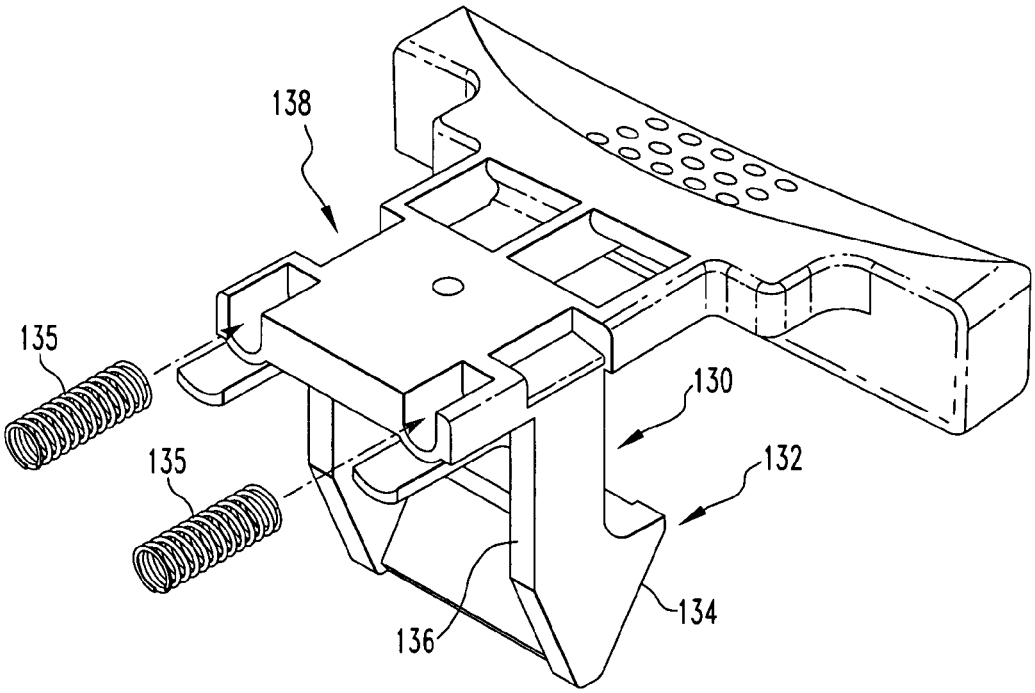
FIG. 8 is a schematic representation of a perspective view of the latch.

Preferably, the latch 110 has a first stem 130 that extends perpendicular away from the bottom 124 surface of the platform 105, as shown in FIG. 8. The stem 130 has a hook 132 that catches with the crossbar 116 and an angled surface 134 that slides by the crossbar 116 as the platform 105 is moving to a horizontal position and forces the stem 130 to slide back and clear the crossbar 116.

The present invention pertains to a method for establishing a step stool 99. The method comprises the steps of moving a latch 110 of a platform 105 only in translation away from a crossbar 116 of a second section 103 that the platform 105 rests on in a horizontal position. There is the step of placing the second section 103 and a first section 100 having at least one step together into a closed position. Preferably, there is the step of expanding a spring 113 in the latch 110 as the latch 110 moves past the cross bar 116.

In the operation of the present invention, the latch 110 does not rotate; rather, it slides as it is cammed by the crossbar 116 attached to the rear section of the step stool 99. As the latch 110, attached to the platform 105, is lowered against the crossbar 116, the latch 110 is forced horizontally away from the rear portion of the step 114. This is caused by the angled surface 134 of the latch 110 to the crossbar 116. The angle is such that the horizontal component of the striking force is sufficient to slide the latch 110 across the underside of the step 114, as shown in FIGS. 4-7.

A gusset 136 is placed on the rear side of the latch 110 to oppose the moment created by the crossbar 116 striking at such an angle. The ribs 115 that stand perpendicular to the sliding latch 110 direction act as a trap 73 for the latch 110. This minimizes the components and complexity of the latch 110.

The latch 110 is comprised of two main components and three subcomponents. The latch 110 engages the crossbar 116 to lock the step stool 99 in the fully open position. The slider handle 109 is connected to the latch 110 and allows the latch 110 to move parallel to the step 114 underside. The slider 138 is trapped in the rib 115 by a series of cutouts 77 that trap the slider 138 in 4 of 6 directions of movement. The subcomponents include a screw 112 that attaches the latch 110 to the slider 138 as well as two snap hooks 132 from the latch 110 to the slider 138. This attachment allows the latch/slider to be trapped in the sixth dimension between two adjoining ribs 115 to restrict overall length of travel. Two springs 135 round out the subcomponents used in the step latch 110. These springs are trapped to the ribs 115 and to the slider 138 portion of the latch 110 assembly. This allows for the slide to be in the extended position until either the latch 110 is engaged by the crossbar 116 while opening the step stool 99 or if the user compresses the latch 110 handle 102 releasing the latch 110 and crossbar 116 to close the step stool 99.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A method for establishing a step stool comprising the steps of:

moving a latch of a platform of the step stool only in translation away from a crossbar of a second section that the platform rests on in a horizontal position, the platform has a slider having a handle connected to the latch which moves the latch only in translation away from the cross bar when the platform is in the horizontal position and the slider handle is moved, which frees the crossbar from the latch and allows a first section of the step stool and the second section to fold together, the platform has a front side and a back side opposing the front side and the slider handle is disposed adjacent the back side, the platform has a top and bottom and the latch is disposed on the bottom of the platform and extends from the bottom of the platform approximately at the bottom's center and in spaced relation from the backside, the platform includes a trap which traps the slider and latch in the platform, the latch extends from the trap away from the bottom of the platform and the slider extends from the trap in parallel with the bottom and through an opening in the backside, the latch has a stem that extends perpendicular away from the bottom surface of the Platform, the stem has two snap hooks that catches with the crossbar, each snap hook having and an angled surface that slides by the crossbar as the platform is moving to a horizontal position and forces the stem to slide back and clear the crossbar, a gusset is placed on the rear side of the latch to oppose the moment created by the crossbar striking at an angle, wherein the moving step includes the step of limiting movement of the slider and the latch by ribs on the bottom of the platform that stand perpendicular to the sliding latch direction, wherein the ribs and cutouts define the trap and including the step of expanding a pair of springs trapped between the ribs and recesses formed which seats the springs on the slider as the latch moves past the cross bar; and placing the second section and the first section having at least one step together into a closed position.

* * * * *